United States Patent [19]

Tobeta et al.

[11] 4,193,256

[45] Mar. 18, 1980

[54] DIGITAL CLOCKS PROVIDED WITH TIME SWITCH MECHANISMS

[75] Inventors: Kanji Tobeta, Tokyo; Shuji Otsuka, Yonezawa, both of Japan

[73] Assignee: Tamura Electric Works, Ltd., Tokyo, Japan

[21] Appl. No.: 874,831

[22] Filed: Feb. 3, 1978

[30] Foreign Application Priority Data

| | | | |
|---|---|---|---|
| Jun. 3, 1977 | [JP] | Japan | 52-72389[U] |
| Jun. 16, 1977 | [JP] | Japan | 52-70446 |
| Jun. 30, 1977 | [JP] | Japan | 52-78544 |

[51] Int. Cl.[2] ..... G04B 23/00; G04B 19/30

[52] U.S. Cl. ..... 368/74; 368/77; 368/222; 368/235

[58] Field of Search ..... 58/7, 16 R, 16 D, 19 R, 58/21.1, 21.13, 21.15, 21.155, 22, 23 R, 50 R, 125 C, 126 E, 128; 200/35 R, 35 A; 40/107, 111, 119, 475; 340/378 A; 235/104

[56] References Cited

U.S. PATENT DOCUMENTS

| | | | |
|---|---|---|---|
| 3,721,087 | 3/1973 | Boyles et al. | 58/126 E |
| 3,831,303 | 8/1974 | Funaki | 40/28 C |
| 3,924,309 | 12/1975 | Robinson | 58/16 D |
| 3,953,965 | 5/1976 | Tobeta | 58/125 C |
| 3,965,668 | 6/1976 | Tomokazu et al. | 58/126 E |
| 4,050,232 | 9/1977 | Taguinuma | 58/52 R |
| 4,060,972 | 12/1977 | Kimura et al. | 58/16 D |

*Primary Examiner*—Vit W. Miska

*Attorney, Agent, or Firm*—Charles E. Pfund

[57] ABSTRACT

Various digit display units and digit shift means disposed between adjacent digit display units are mounted on two parallel supporting shafts extending between opposing side walls of a frame. A motor for driving the least significant digit is mounted on the outside of one side wall, and a time switch mechanism comprising a timer setting wheel, a cam gear and a timer lever is disposed between the other side wall and a sub-plate spaced therefrom. Cams are secured on the opposite ends of a shaft which supports the digit shift means, one of the cams engaging the timer lever, while the other cam engaging a buzzer operating member vibrated by the leakage flux of the motor. The operation of the timer lever is transmitted to the buzzer operating member through the digit shift means supporting shaft.

9 Claims, 10 Drawing Figures

DIGITAL CLOCKS PROVIDED WITH TIME SWITCH MECHANISMS

BACKGROUND OF THE INVENTION

This invention relates to a digital clock, more particularly to a digital clock provided with a time switch mechanism.

Various types of the digital clocks of the type just mentioned have been proposed in the past, but a digital clock of the most common type comprises a hour display unit, minute display unit, a second (the least significant digit) display unit which also serves as an operation display unit which displays whether the clock is operating continuously or not and a timer setting wheel utilized to set time.

The layout of various component elements of such digital clock has been limited by the following reasons.

More particularly, while a synchronous motor is used to drive a hour display unit of the drum type, leaf type or shutter type, it is necessary to locate the synchronous motor on the lower digit side of the hour display unit for the purpose of simplifying the motion transmission mechanism.

Furthermore, in order to improve the convenience of use and appearance it is desirable to locate the hour display unit at the center and to locate such auxiliary mechanisms as the second display unit or the operation display unit and the timer setting wheel display unit on both sides of the hour display unit.

Since a buzzer incorporated with a time switch mechanism is operated by the leakage flux of the synchronous motor, it is desirable to locate the buzzer as close as possible to the synchronous motor in order to simplify the motion transmission mechanism thereby decreasing the cost.

Moreover, it is desirable that the assembly and disassembly of the clock can be made as readily as possible. Especially, since the time switch mechanism is fabricated with a relatively large number of small component parts and moreover since the parts are constructed to rotate or swing it has been desirable to simplify troublesome assembling operation.

Where a so-called repeat mechanism is provided which repeatedly rings at a definite interval when the time switch operates it is desirable to simplify as far as possible such repeat mechanism for the purpose of avoiding misoperation. Of course, such mechanism should have a simple construction and can be assembled readily.

In consideration of these points, it was a common practice in the past to adopt a structure such as in U.S. Pat. No. 3,495,396.

In all such structures, however, an exclusive lever independent of the rest of the transmission systems was used for the transmission system between the timer layer related to the timer setting wheel and the buzzer system disposed on the side of the synchronized motor.

Further, the prior art time switch system mentioned above was in a structure for which the component parts had to be assembled in order from one direction, and for this reason, when a part of the structure required adjustment after the completion of assembling, the whole structure had to be dismantled.

SUMMARY OF THE INVENTION

Accordingly, it is the principal object of this invention to provide a new and improved digital clock provided with a time switch mechanism which is simple in construction and can be assembled readily but can satisfy the requirement described above regarding the convenience of use and the appearance.

Another object of this invention is to provide a novel digital clock provided with a time switch mechanism which is simple in construction and can be assembled readily.

A further object of this invention is to provide an improved digital clock provided with a repeat mechanism and a time switch mechanism which can be operated readily.

According to this invention there is provided a digital clock provided with a time switch mechanism, comprising parallel shafts extending between opposing side walls of a frame, a plurality of digit display units mounted on the parallel shafts, for displaying respective digits, digit shift means also mounted on the parallel shafts between adjacent digit display units for shifting time digits from lower digits to upper digits, a driving motor mounted on one side wall for driving a least significant digit display unit, a sub-plate confronting the other side wall, a time switch mechanism including a timer setting wheel, a cam gear and a timer lever and located between the other side wall and the sub-plate, cam members secured to the opposite ends of a shaft for supporting the digit shift means, a buzzer operating member operated by the leakage flux of the driving motor, one of the cam members engaging the timer lever, whereas the other cam member engaging the buzzer operating member, and means for transmitting the motion of the timer lever to the buzzer operating member through the shaft for supporting the digit shift means.

BRIEF DESCRIPTION OF THE DRAWINGS

Further objects and advantages of the invention can be more fully understood from the following detailed description taken in conjunction with the accompanying drawings in which.

DESCRIPTION OF THE PREFERRED EMBODIMENT

Figure 6:
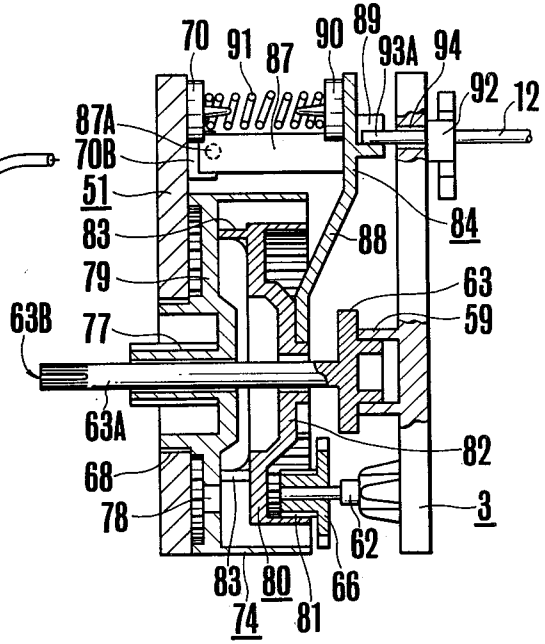
FIG. 6 is a horizontal sectional view of the time switch mechanism.
Figure 1:
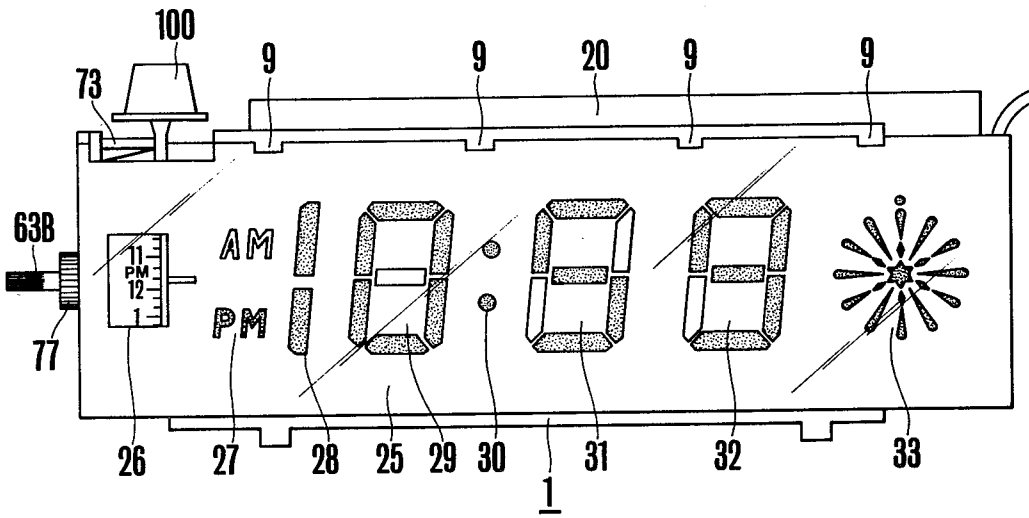
FIG. 1 is a front view showing one embodiment of a shutter type digital clock provided with a time switch mechanism and constructed according to the teaching of this invention.
Figure 2:
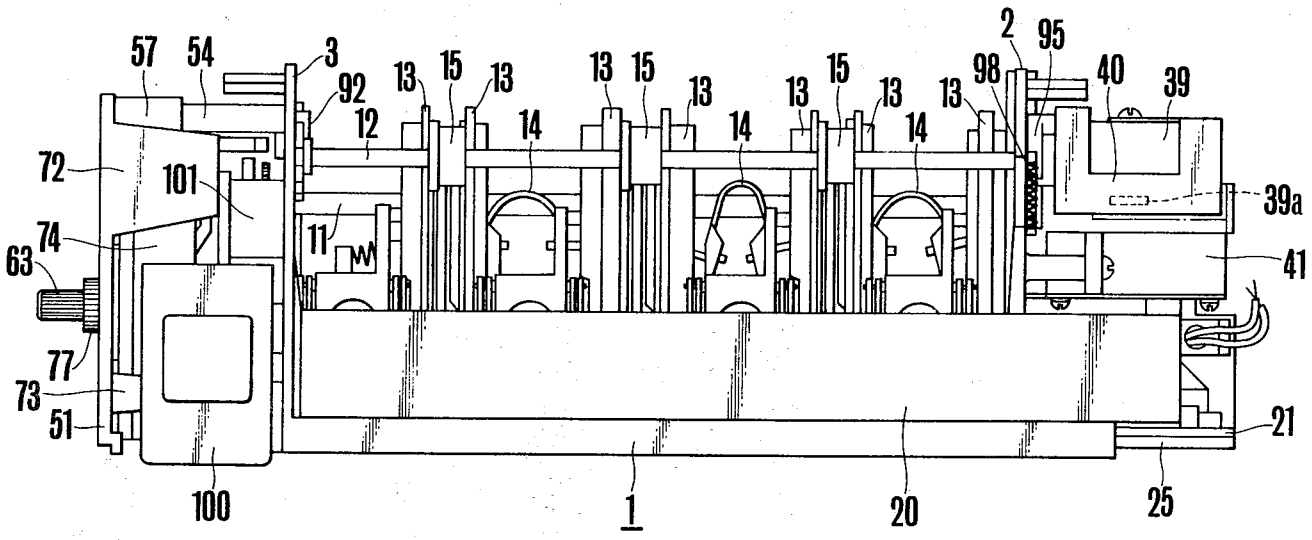
FIG. 2 is a plan veiw of the digital clock shown in FIG. 1.
Figure 3:
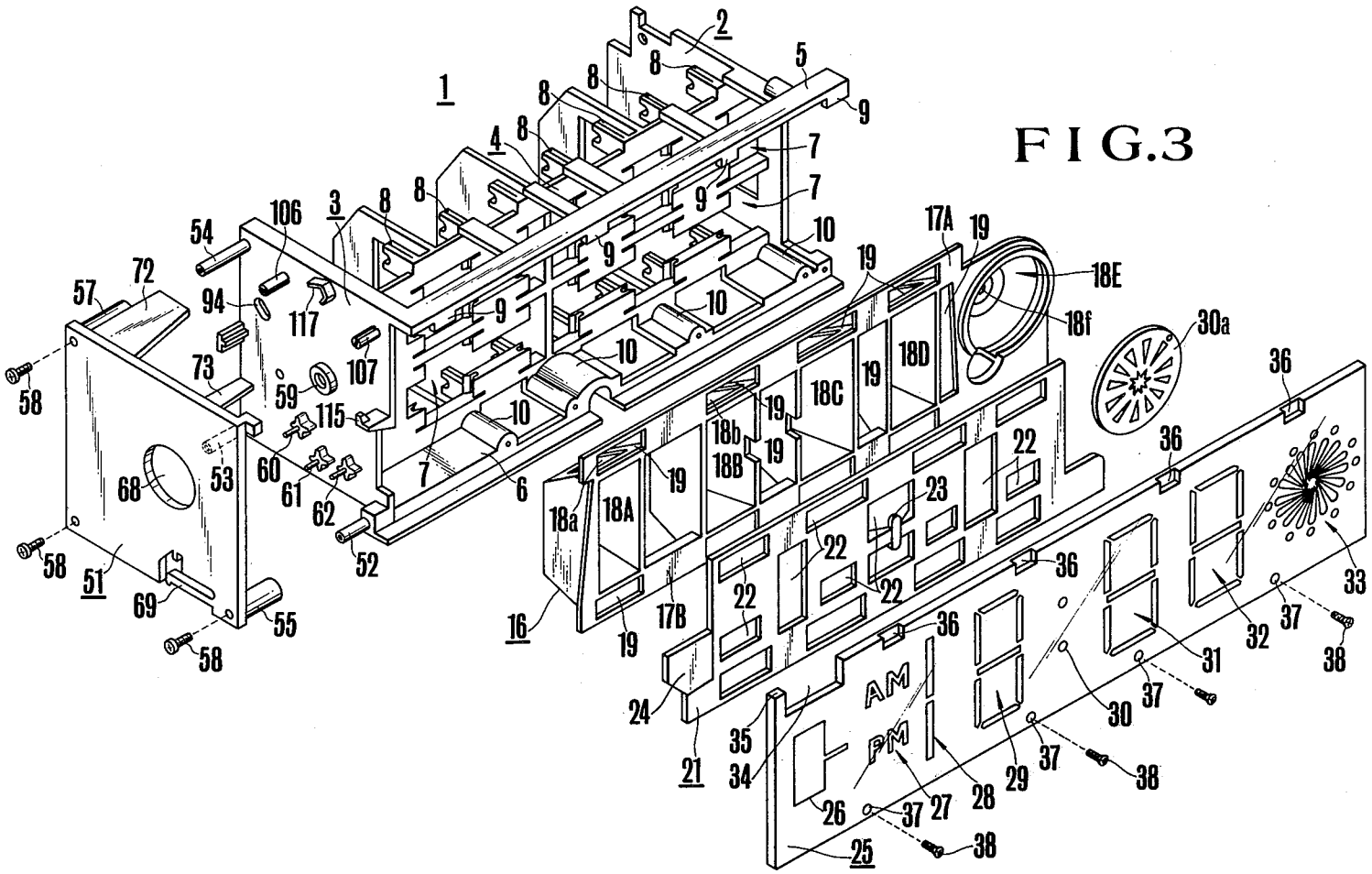
FIG. 3 is an exploded perspective view showing the construction of the frame and various digit display units assembled thereon.
Figure 4:
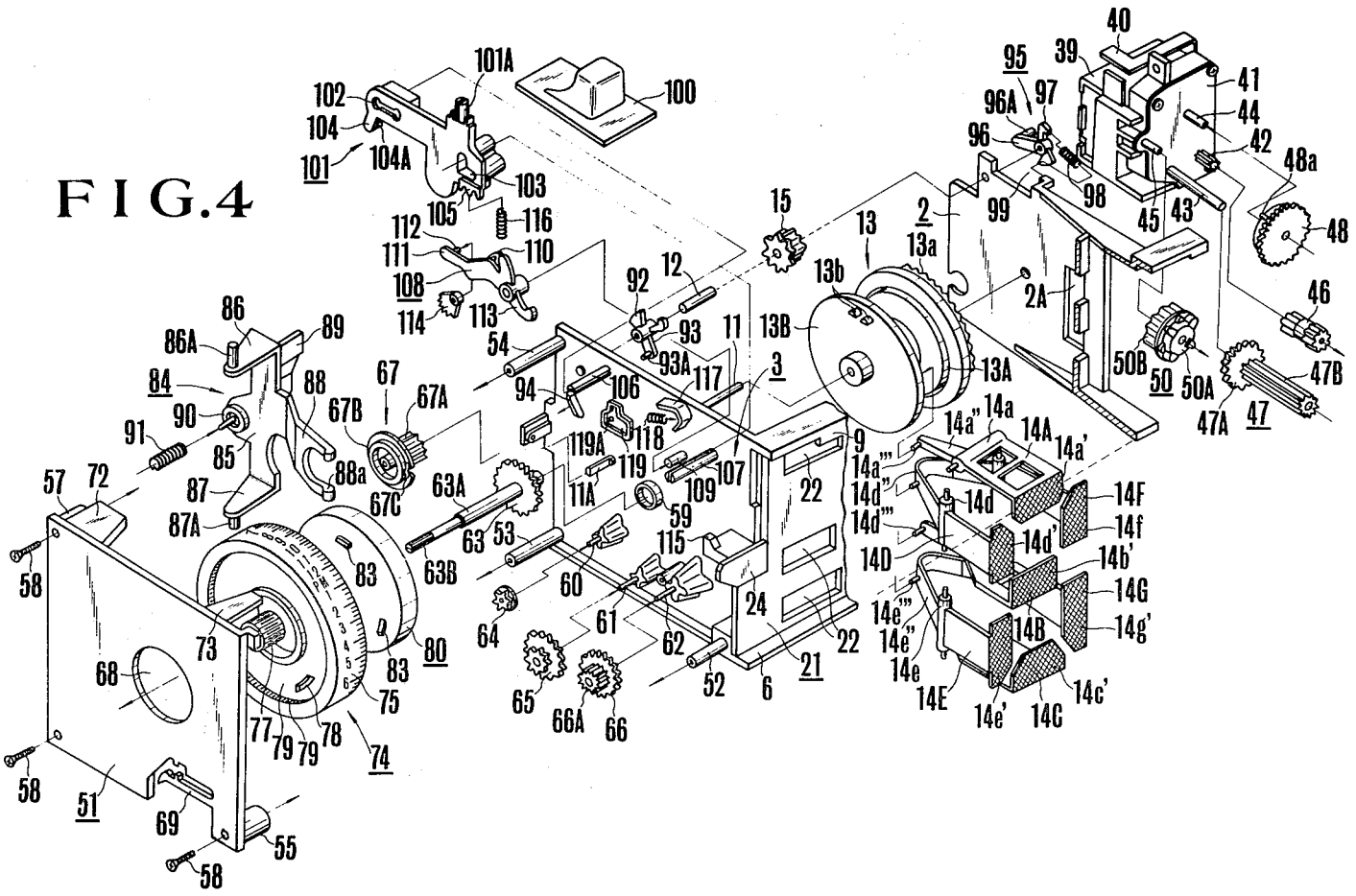
FIG. 4 is an exploded perspective view showing the detail of various motion transmission members.

A preferred embodiment of the shutter type digital clock shown in FIGS. 1 through 10 comprises a frame 1 made of a synthetic resin, for example, and including opposed side walls 2 and 3, an intermediate wall 4 and upper and lower beams 5 and 6, as best shown in FIG. 3. To the outer surface of one side wall 2 is mounted a driving motor 39 as will be described later, while the other side wall 3 acts as a partition wall for partitioning a time display unit and a time switch mechanism. The intermediate wall 4 is formed with a plurality of shutter guide windows 7, and a plurality of shutter supports 8 are secured to the rear surface of the intermediate wall 4. A plurality of hook shaped projections 9 are provided for the front edge of the upper beam 5 whereas the lower beam 6 is provided with a plurality of screw receiving members 10 which are used to receive screws, not shown, utilized to assemble a reflector 16, an intermediate plate 21 and a front plate 26 as will be described later. The opposite ends of two parallel shafts 12 and 13 are supported between the side walls 2 and 3. A pair of cam discs 13A and 13B, having a construction as shown by FIG. 4 is mounted on the shaft 11, one pair for each digit or order. To one side of the cam disc 13A is secured a gear **13*a* which is driven from the lower side while to one side of the other cam disc 13B is secured a digit shift segment gear 13*b*. The cam disc 13B and the digit shift segment gear 13*b* rotate in unison. Each of the cam discs 13A and 13B of each digit is formed with a number of cam grooves on its inner side for receiving a cam pin of the shutter unit. Among various digit cam discs, the cam disc of the minute digit is secured to the shaft 11 whereas the cam discs of the other digits are rotatably mounted on shaft 11**.

One of the shutter units driven by the cam discs described above is used for an AM.PM digit, two units for a ten o'clock digit and 7 units for hour digits and minute digits. Seven shutter members 14A through 14G (sometimes merely designated by 14) shown in FIG. 4 are made of a synthetic resin. Four shutter members 14D through 14G adapted to open and close display segment openings aligned in the vertical direction are grouped into upper and lower pairs, each pair being interconnected by a thin resilient band so that shutter members of each pair are biased to separate from each other in the horizontal direction as viewed in FIG. 4. At substantially the center of respective shutter members are provided pivot pins **14*a* through 14*g* light intercepting or opaque shutters 14*a*' through 14*g*' are mounted on the fore ends of respective shutter members while cam arms 14*a*'' through 14*g*'' including cam pins 14*a*''' through 14*g*''' are projecting from the rear surfaces of respective cam members. As shown in FIG. 2, digit shift pinions 15 are mounted on the shaft 12. Each digit shift pinion is interposed between adjacent digit cam discs 13** so as to simultaneously transmit the rotation of lower digit cam discs to upper digit cam discs.

As best shown in FIG. 3, a reflector 16, an intermediate plate 21 and a front plate 25 are disposed in front of the frame 1. The reflector 16 is provided with downwardly projecting plate shaped flanges 17A and 17B, and a plurality of chambers 18A through 18E corresponding to respective digits, and the flanges 17A and 17B are formed with guide openings 19 for guide members. Although not shown in the drawing, the ceilings of respective chamber 18A through 18E are provided with openings **18*a* through 18*e* for inserting lamps into respective chambers, the lamps being supported by a holder 20 shown in FIG. 1. The chamber 18E for the least significant digit is conical and a circular operation display plate 30*a* is rotatably received in the fore end of the conical chamber 18E. Although not shown in the drawing, on the back of the operation display plate 30*a* is formed gear which is rotated by a stepped gear 47 of a driving motor 39, at a rate of one revolution per minute as will be described later in more detail. The intermediate plate 21 is located in front of the reflector 16 and made of a colored synthetic resin and having a longitudinal dimension sufficient to cover all of the chambers 18A through 18D. The intermediate plate 21 is also formed with guide openings 22 for shutter members 14. Furthermore, the intermediate plate 21 is formed with a display member 23 for separating the hour and minute digits and a display member 24** for displaying the needle of a timer setting wheel.

The fore plate 25 is made of a transparent synthetic resin and a black light shielding film, not shown, is printed on the rear surface of the plate 25 except display patterns. More particularly, segments of a timer setting wheel display unit **2*f* the time switch mechanism, an AM.PM display unit 27, a ten o'clock digit 28, a hour digit 29, a colon 30 for sectionalizing the hour and 10 minute digits, a 10 minute digit 31, a minute digit 32 and an operation display unit 33 are left transparent while the other portions are formed with light intercepting film. A notch 34 and a projection 35 are formed on the upper edge of the fore plate 25 near its left end and a plurality of notches 36 are formed on the upper edge corresponding to the hook shaped projections of the upper beam 5. The fore plate 25 is also provided with perforations 37 corresponding to the screw receiving members 10 of the lower beam 6. The fore plate 25 is fastened to the front opening of frame 1 by receiving the hook shaped projections in the notches 36 and by inserting screws 38 into the screw receiving members 10 through perforations 37**.

With the construction described above, shutters **14*a* through 14*j* of the shutter members 14 are guided to project forwardly by the guide openings 19 and 22 of the reflector 16 and the intermediate plate 21 respectively, and terminate close to the rear surface of the fore plate 25. Respective shutters selectively open and close respective digit display patterns on the rear surfaces of transparent segments so as to digitally display the present time. Of course, the shutters of respective shutter members are colored to the same color as the fore plate 25**.

Figure 5:
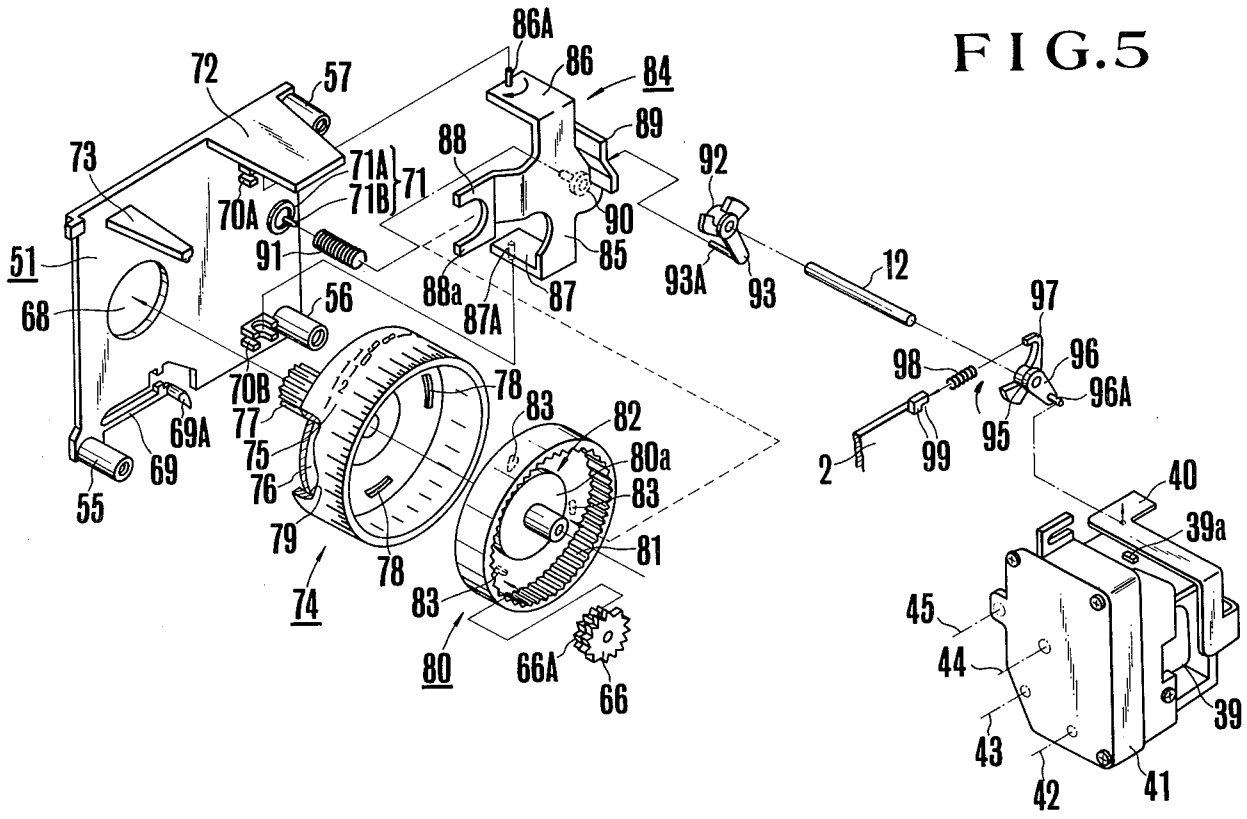
FIG. 5 is an exploded perspective view showing the setter of the time switch mechanism and component elements associated therewith.

The component elements described above constitute a time display unit and the minute digit cam disc thereof is intermittently driven by the synchronous motor 39 which is connected to a gear box 41, as shown in FIGS. 2 and 4, which contains a reduction gear train including means for preventing reverse rotation, and driven by the rotor of the motor 39. As shown in FIGS. 2 and 5, one pole piece **39*a* projects outwardly through the casing of the motor 39 to face the free end of a buzzer vibrating piece 40. One end of the piece 40 is secured to the stator core of the motor 39 and the gap between the pole piece 39*a* and the buzzer vibrating piece 40 is selected in such manner that the piece 40 normally vibrates under the influence of the leakage flux of the pole piece 39*a*. A serrated shaft 42 integral with the reduction gear train extends through the side surface of the gear box 41 and a plurality of studs 43, 44 and 45 are secured to said one side surface. The serrated shaft 42 meshes a cycle switching gear 46 (FIG. 4) which is generally cylindrical and formed with adjacent gears having teeth ratio of 4:6. The cycle switching gear meshes a large diameter gear 47A of a stepped gear 47 which is rotatably mounted on stud 43. The small diameter gear 47B of the stepped gear 47 projects into the chamber 18E of the reflector 16 through an opening 18*f* thereof and meshes the gear of the operation display plate 20 for rotating the same. The small diameter gear 44B also meshes a gear 48 (FIG. 4) which is rotatably mounted on the stud 44. A segment gear 48*a* for shifting the digit is secured to the rear surface of the gear 48 so as to intermittently drive a cam drive gear 50 by the rotation of gear 48. The cam drive gear 50 is rotatably mounted on a stud 45 and constituted by a pinion 50A meshing with the segment gear 48*a* and an adjacent pinion 50B having a width different from that of pinion 50A. A portion of the pinion 50B extends through a notch 2A provided for the side wall 2 of the frame to mesh and drive the gear 13*a* of the minute digit cam disc 13**.

The cam disc shaft 11 extends through the side wall 3 of the frame for driving the time switch mechanism by its machined end 11A. The time switch mechanism comprises a motion transmission member constituted by a plurality of groups of gears and a set controller utilized to set time and control the buzzer vibrating piece 40. The transmission member is supported by the side wall 3 of the frame whereas the set controller is mounted on a sub-plate 51.

As shown in FIG. 3 studs 52, 53 and 54 respectively provided with axial bores are secured to three corners of the side wall 3. Also, studs 55, 56 and 57 are secured to the inner surface of the sub-plate 51 at positions corresponding to studs 52, 53 and 54 as shown in FIGS. 3 and 5. The studs 55, 56 and 57 secured to the sub-plate are provided with axial perforations for receiving set screws 58 thereby securing the sub-plate 51 to the side wall 3 with a suitable gap therebetween.

The construction of the transmission member is clearly shown in FIG. 4. More particularly, a bearing bushing 59 is secured to the front surface of the side wall 3 at about the center thereof and three spaced apart parallel studs 60, 61 and 62 are secured beneath the bearing bushing 59. The bearing bushing 59 supports one end of a shaft which supports a timer setting wheel 74, cam gear 80 (to be described later) and a time correction gear 63 and this shaft is also used for time correction. The boss 63A and the time correction gear 63 extends toward the sub-plate 51 and a knob, not shown, is secured to the knurled end 63B of the shaft. First to third studs 60, 61 and 62 rotatably support a pinion 64, a gear 65 and a stepped gear 66 respectively. The gear 66 has a small diameter gear 66A having a larger thickness. These gears constitute a rotary motion transmission system.

A timer driving gear 67 is secured to one end 11A of the cam disc shaft 11, as shown in FIG. 4. The gear 67 comprises a circular disc 67B, and a spur gear 67A meshing the time correction gear. A segment gear **67*c* is provided for a portion of the periphery of the circular disc 67*b* so that when gear 67 rotates one revolution, that is when the minute digit cam disc makes one revolution, the pinion 64** is rotated a definite angle.

As shown in FIG. 5, a circular opening 68 is formed through the central portion of the sub-plate 51 through which one end of the boss 63A of the time correction gear 63 extends outwardly. A tongue 69 is provided for the lower edge of the sub-plate 51 at a position beneath opening 68, and a click pawl 69A is formed on the outer end of the tongue 69. As shown in FIG. 5, vertically spaced apart supporting members 70A and 70B are secured to the rear surface of the sub-plate 51 for supporting a timer lever 84. A spring anchor 71 comprising an annular ring 71A and a guide pin 71B at the center thereof is secured to the rear surface of the sub-plate near its righthand edge and between the supporting members 70A and 70B. Plate shaped lever receiving members 72 and 73 are secured to the rear surface of the sub-plate 51 to project toward the side wall 3 from the upper edge of the side plate. The timer setting wheel 74, cam gear 80 and the timer lever 84 are assembled on the sub-plate 51 to constitute the set controller.

The timer setting wheel 74 takes the form of a bottomed cylinder and a set index 75 is printed about the periphery thereof. A boss 77 projecting from the bottom wall 76 of the timer setting wheel 74 extends outwardly through the opening 68 to be secured with a set knob, not shown. A plurality of arcuate grooves 78 are formed on the bottom wall 76 at different radial positions. On the inner periphery of a rim of the timer setting wheel which extends slightly from the bottom wall 76 toward the sub-plate 51 is formed a one way ratchet gear 79 corresponding to the index 75. When the timer setting wheel 74 is assembled it is engaged by the pawl 69A of the click lever 69 thus permitting stepwise unidirectional rotation during the setting operation described later. The cam gear 80 is also formed as a bottomed cylinder having a slightly smaller outer diameter and width than the timer setting wheel 74 to be nested therein. An internal gear 81 is formed on the entire inside periphery to mesh the gear 66 of the motion transmission member to be rotated a definite angle per 10 minutes. On the outer surface of the bottom wall 82 of the cam gear 80 facing the sub-plate 51 are secured wedge shaped cam projections 83 at positions corresponding to cam grooves 78. The cam gear 66 is mounted on the elongated boss 63B of the time correction gear 63 to be slidable in the axial direction thereof, and normally urged by a timer lever 84 toward left as viewed in FIG. 5.

As shown in FIG. 5, the timer lever 84 comprises a vertical base 85, legs 86 and 87 formed by bending the upper and lower ends of the base toward the sub-plate 51, a stepped arm 88 extending forwardly from the middle portion of the lefthand edge of the base 85, a crankarm shaped cam 89, projecting toward the side wall 3 from the righthand edge of the base and a spring anchor 90 secured to one side of the base. Pins 86A and 87A are secured to the legs 86 and 87 respectively to engage supporting members 70A and 70B respectively thereby tiltably supporting the timer lever 84 on the sub-plate 51. The outer end of the arm 88 is bifurcated as at **88*a* for engaging the side surface 80*a* of the cam gear 80. The spring anchor 90 has the same construction as the spring anchor 71 on the sub-plate 51 and has an annular wall 90A and a central guide pin 90B (see FIG. 4). A compression spring 91 is interposed between spring anchors 71 and 70 for urging the timer lever 84 to rotate about pins 86A and 87A in the clockwise direction as viewed in FIG. 5**.

Accordingly, the cam gear 80 is urged by the arm 88 to move toward the timer setting gear 74 so that the cam projections 83 of the cam gear slide along the bottom wall 76 of the timer setting wheel 74. As above described, since the cam wheel 80 is intermittently rotated with time, the positions of its cam projections 83 always correspond to time. As a consequence, when the timer setting wheel 74 is manually rotated by a definite angle, the relative circumferential distances between cam grooves 78 of the timer setting wheel and the cam projections 83 of the cam gear 80 are varied thus setting the time of the time switch mechanism.

A cam member 92 (FIGS. 4 and 5) is actuated by the cam 89 of the timer lever 84. More particularly, the cam member 92 is secured to one end of the shaft 12 (shown in FIGS. 2, 4 and 5) and includes a cylindrical boss and an arm 93 projecting therefrom. The arm 93 has an axial pin 93A which extends through a slot 94 provided through the side wall 3 to engage the outer surface of the cam 89 of the timer lever 84. The shaft 12 extends through the side wall 2 and a cam member 95 shown in FIGS. 4 and 5 is secured to one end of the shaft 12. The cam member 95 also comprises a cylindrical boss, an arm 96 extending therefrom and a spring anchor 97, the arm 96 having an axial pin 96A. In this embodiment, two similar cam members 92 and 95 are mounted on the shaft 12 in the back-to-back relationship. The free end of pin 96A extends beneath the buzzer vibrating piece 40. The buzzer vibrating piece 40 is constructed such that under normal condition, it is located close to the pole piece 39A of the driving motor 39 so as to be vibrated by the leakage flux of the pole piece thereby producing buzzer tone. One end of a compression spring 98 is secured to the spring anchor 97 and the other end is connected to the anchor 99 formed on the upper edge of side wall 2. Accordingly, the cam member 95 is biased in the clockwise direction as viewed in FIG. 5. When the cam projections 83 of the cam gear 80 ride on the bottom wall 76 of the timer setting wheel 74, the timer lever 84 is located at the leftmost position as viewed in FIG. 7 and its cam member 89 raises pin 39A of the cam member 92 to the left end of the groove 94 of the side wall 3. Accordingly, the other cam member 95 is rotated in the counterclockwise direction against the force of spring 98 so as to push up the buzzer vibrating piece 40 by its pin 96A. As a consequence the gap between the buzzer vibrating piece 40 and the pole piece **39*a* is increased thus locking the buzzer vibrating piece 40** against vibration.

A predetermined time later, the cam projections 83 of the cam gear 80 are rotated to positions respectively corresponding to cam grooves 78 of the timer setting wheel 74, in other words a time set by the time switch mechanism is reached, cam projections 83 would be received in corresponding cam grooves 78. Then, the cam gear 80 is moved on the elongated boss 63A of the time correction gear 63 toward the left as viewed in FIG. 6 by the force of spring 91 whereby the timer lever 84 engaged by cam gear 80 is rotated in the clockwise direction as viewed in FIG. 6 about pins 86A and 87A. Accordingly, the pin 93A of the cam member 92 disengages from cam member 89, and the cam member 92, shaft 12 and cam member 95 are rotated in unison in the clockwise direction by the force of spring 98. Consequently, the locking of the buzzer vibrating piece 40 by pin 96A of the cam member 95 is released so that the buzzer vibrating piece 40 lowers to its normal position close to the pole piece **39*a*. Accordingly, the piece 40 is vibrated by the leakage flux of the pole piece to produce awakening buzzer tone. The ringing of the buzzer is continued so long as the cam projections 83 are engaging cam grooves 78 and automatically terminated when the cam projections 83 come to ride on the bottom wall 76 of the timer setting wheel 74 as the time elapses, thus resuming the state shown in FIG. 7**.

The time of ringing of the buzzer is determined by the circumferential length of the cam grooves 78. Normally, since this time is set to about 30 minutes to one hour, it is necessary to provide a manually operable buzzer stopping mechanism.

The buzzer stopping mechanism comprises a repeat mechanism which is mounted on the side wall 3 and constructed such that at the time of switching the ON-OFF operations of the buzzer and when the ringing of the buzzer is once stopped, the buzzer rings again after about 5 minutes, for example. As shown in FIG. 4 the buzzer stopping mechanism comprises a switching lever 101 having a switching knob 100 secured to its head 101A, a repeat lever 108 associated with the switching lever 101, and a repeat gear 114 supported by the repeat lever 108.

The switching lever 101 takes the form of a plate like member extending in the fore and aft direction of the clock, and as shown in FIG. 4, a longitudinal slot 102 is provided for the rear end of the lever, whereas a L shaped slot 103 is provided for the fore end. A downwardly projecting arm 104 is provided for the rear end and a pin 104A extends from the arm 104 toward one side wall. A bifurcated spring anchor 105 is formed on the lower edge of the fore end of the switching lever 101. The switching lever 101 is supported with the slitted pins 106 and 107 on the side wall 3 received in the slots 102 and 103.

Figure 9:
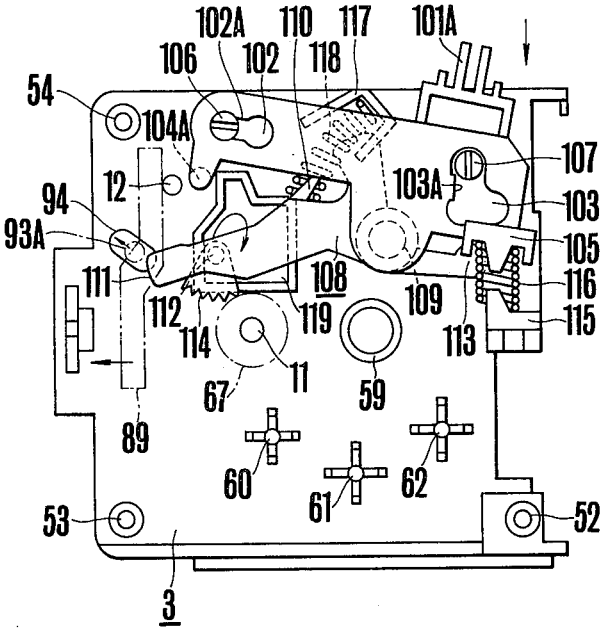
FIG. 9 is a view similar to FIGS. 7 and 8 showing the repeat set operation.

As shown in FIGS. 7 through 10, the width of both ends of slot 102 is substantially equal to the diameter of the pin 106 but the width of the central portion of the slot is a little smaller. The pin 106 is provided with a slit extending in the direction of the slot 102. The width of a portion 103A of the L shaped slot 103 is slightly decreased as shown in FIG. 9 and the pin 107 is provided with a slit extending in the direction of the vertical leg of the slot 103.

Figure 7:
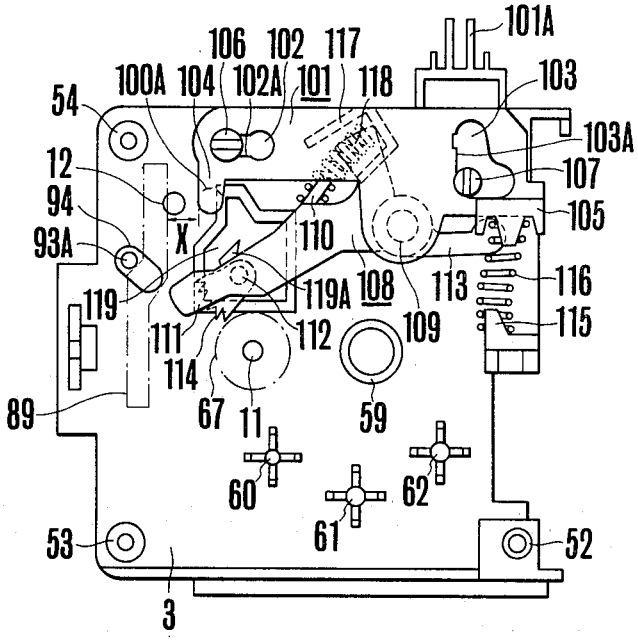
FIG. 7 is a side view of the time switch mechanism in the ON set state.
Figure 8:
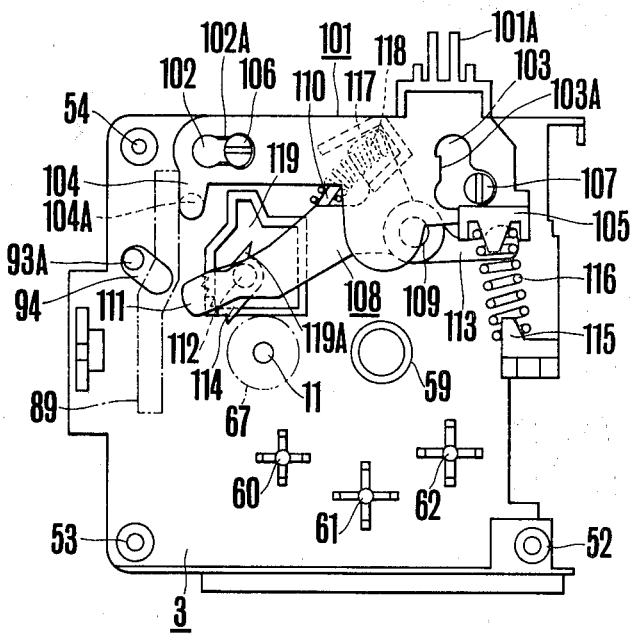
FIG. 8 is a view similar to FIG. 7 showing the time switch mechanism in the OFF set state.

As shown in FIG. 7, the arm 104 and the pin 104A thereof are positioned inside of the cam member 89 of the timer lever 84. When the switching lever 101 is moved in the fore and aft direction, the time switch mechanism is switched between the ON and OFF states. FIG. 7 shows the ON state wherein the switching lever 101 is located at the fore position. Under these conditions, a predetermined spacing X is maintained between the arm 104 and its pin 104A, and the cam member 89 of the timer lever 84. As a consequence, when the cam projections 83 are received in cam grooves 78 so as to operate the timer lever 84, the cam member 89 can move to the left as viewed in FIG. 7 whereby the cam pin 93A is released from the cam member 89 to operate the buzzer. Then, the switching lever 101 is moved rearwardly to set the state shown in FIG. 8. At this time, when passing through the narrow portion 102A of slot 102, the diameter of the pin 106 is reduced by the action of its slit thus producing a click action. At this time, the arm 104 and pin 104A of the lever 101 engage the inner side of the cam member 89 of the timer lever 84. For this reason, even when the cam projections 83 are brought to the positions of the cam grooves at the set time, the timer lever 84 can not operate and the cam pin 93A is engaged by the cam member 89 so that the buzzer would not ring. Of course, when the switching lever 101 is switched to the OFF state while the buzzer is ringing the arm 104 resets the timer lever 84 to the OFF state with the result that the cam shaft 93A is moved to the position shown in FIG. 8 by the cam member 89, thus immediately stopping the ringing of the buzzer.

Repeat Mechanism

The repeat lever 108 described above is interposed between the switching lever 101 and the side wall 3 of the frame. Thus, the repeat lever 108 is swingably mounted on the stud 109 projecting from the side wall 3 and provided with a spring anchor 110 at a portion of its upper edge. A pin 112 is provided near the rear end 111 on the side of the lever facing the side wall 3. The fore end 113 of the lever 108 is formed as a cam member extending beneath the switching lever 101. A sector gear 114 is loosely mounted on the pin 112 and located close to the spur gear 67A of the timer driving gear 67. The repeat lever 108 is subjected to the forces of the compression spring 116 interposed between the spring anchor 105 of the switching lever 101 and spring anchor 115 on the side wall 3, and of the compression spring 118 interposed between the anchor 110 of the lever 108 and the spring anchor 117 provided for the side wall 3. More particularly, the spring 116 acts upon the switching lever 101 to urge it in the counterclockwise direction as viewed in FIG. 7. Thus it does not act directly upon the repeat lever 108 but indirectly influenced through the switching lever 101. The lever 108 is biased to rotate about pin 109 in the counterclockwise direction as viewed in FIG. 7 by the force of spring 118, thus causing the cam member 113 to engage the lower edge of the switching lever 101. At this time, the pin 112 is engaging the guide member 119 provided for the side wall 3. As shown in FIG. 7 the guide member 119 takes the form of a closed wall and a triangular switching member 119A is located at the center of the guide member 119 for controlling the attitudes of the repeat or sector gear 114 during the repeating operation discribed hereinafter.

Figure 10:
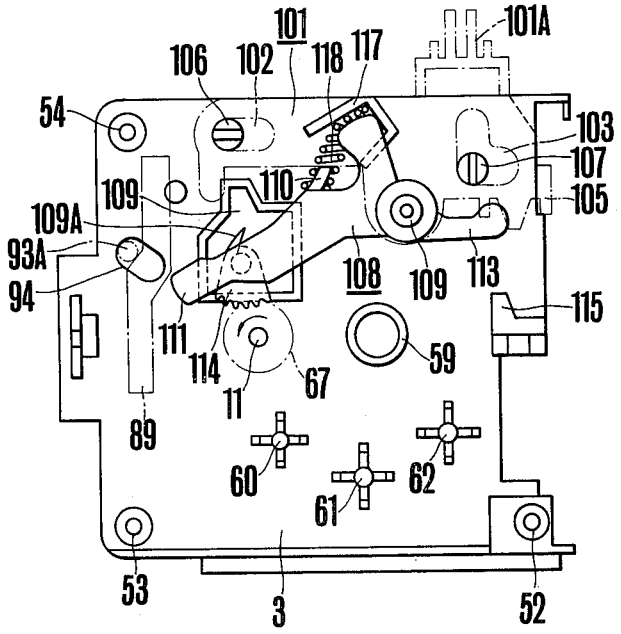
FIG. 10 is a view similar to FIG. 9 showing the repeat operation.

The repeat operation will now be described with reference to FIGS. 7, 9 and 10. Of course, the repeat operation is made possible only when the switching lever 101 sets the timer to the ON state. When it is desired to temporarily stop the ringing of the buzzer which began to ring at a set time, the switching lever 101 is depressed downwardly as shown in FIG. 9. At this time, since the slitted pin 106 for supporting the switching lever 101 is located at the rear end of the slot 102 and since the slitted pin 107 is located at the corner of the L shaped slot 103, the switching lever 101 would rotate about the pin 106 in the clockwise direction as viewed in FIG. 9 against the force of spring 116. At this time also, while passing through the narrow portion 103A of the slot 103, the diameter of the slitted pin 107 is reduced and the click motion is assured by the resistance of the pin 107. Accordingly, the repeat lever 108 also is rotated in the clockwise direction about stud 109 by the force of the spring 118 because its cam member 113 is pressed. At this time, the repeat gear 114 is rotated in the counterclockwise direction with its boss engaged against the switching member of the guide member 119, and the teeth of the repeat gear 114 are maintained in the vertical position. As the repeat lever 108 is rotated, its end 111 comes to engage the cam member 89 of the time lever 84 for urging the cam member 89 to the right as viewed in FIG. 9. Then the cam member 89 rotates the cam member 92 in the clockwise direction by pushing the cam pin 93A of the cam member 92, thus stopping the ringing of the buzzer. When the switching lever 101 is released, the lever 101 will be returned to the original position by the force of spring 116. Accordingly, the repeat handle 108 is also rotated in the counterclockwise direction toward the original position by the force of spring 118. At this time, as shown in FIG. 10 repeat gear 114 comes to mesh the spur gear 67A so that it will not be returned to the original position. Consequently, the end 111 of the lever 108 is still maintained in a state in which it presses rearwardly the cam member 89 of the timer lever 84 thereby holding the cam member 92. The buzzer vibrating piece 40 is prevented from vibrating by being engaged by the pin 96A of the other cam member 95. As the time elapses from the buzzer stopping state, the time drive gear 67 rotates in the counterclockwise direction as viewed in FIG. 10 whereby the repeat gear 114 also rotates in the clockwise direction about pin 112. As a time corresponding to the minute tooth thereof elapses, the repeat gear 114 moves away from the periphery of the timer drive gear 67 as shown in FIG. 7, and the repeat lever 108 is further rotated in the counterclockwise direction by the force of the spring 118. Accordingly, since the cam member 89 is released from the end 111 of repeat lever 108, the cam member 92 is restored to the original position by the force of spring 98 acting on the other cam member 95, whereby the pin 96A of the cam member 95 releases the buzzer vibrating piece 40 thus producing again the buzzer tone. Thereafter, the above described operation is repeated while the cam projections 83 of the cam gear 80 are engaging the cam grooves 78 of the timer setting wheel 74. Thus, the buzzer is repeatedly operated with a predetermined interval.

While the foregoing embodiment has been described in terms of a shutter type digital clock, it will be clear that the time display mechanism may be of any other type and that the time switch mechanism may have any other suitable construction. For example, the timer lever may directly control the buzzer vibrating piece or a switch without using any motion transmission mechanism.

As above described, according to this invention, a time display unit is located at the center, a driving motor and a awakening buzzer mechanism operated by the leakage flux of the motor is located on one side of the time display unit while a time switch mechanism for setting the awakening time is located on the other side. Moreover, the operation of the timer lever of the time switch mechanism is used to drive a pinion shaft which supports a digit shift pinion. This construction not only eliminates a complicated motion transmission mechanism required by the prior art clock but also greatly reduces the number of the component parts and the assembly steps thereby decreasing the cost of manufacturing. Furthermore, even when various auxiliary devices are incorporated, it is not necessary to use any complicated motion transmission mechanism.

Furthermore, according to this invention, as the repeat mechanism is set by the switching lever utilized to switch the time switch between ON and OFF states it is possible to eliminate misoperation of the prior art device caused by the use of a plurality of operating members, thereby simplifying the operation. Moreover, since all the switching lever, repeat lever, etc. act on the cam wall portion of the timer lever and since the cam wall portion acts directly on the buzzer control member it is possible make sure respective operations and simplify the construction.

Furthermore, according to the invention, the motion transmission member and the operating member of the time switch mechanism are supported by a sub-plate 51 coupled to a side wall 3 of the frame so that it is possible to assemble the component parts as different blocks, thereby speeding up the fabrication operation, and permitting easy adjustment. Moreover, the opposite ends of a spring acting upon a timer lever are not secured to the timer lever or other member so that the spring can be readily mounted by merely interposing it between the subplate and the spring anchor of the timer lever after various component elements have been assembled on the sub-plate. This construction not only makes simple the assembling operation but also easy exchange of the component parts.

While the invention has been shown and described in terms of a specific embodiment thereof, it should be understood that many changes and modifications will be obvious to one skilled in the art without departing the true spirit and scope of the invention as defined in the appended claims.

What is claimed is:

1. A digital clock provided with a time switch mechanism, comprising parallel shafts extending between opposing side walls of a frame, a plurality of digit display units mounted on said parallel shafts for displaying respective digits, digit shift means also mounted on said parallel shafts between adjacent digit display units for shifting time digits from lower digits to upper digits, a driving motor mounted on one side wall for driving at least significant digit display unit, a sub-plate confronting the other side walls, a time switch mechanism including a timer setting wheel rotatable to select a set time and having cam receiving means, a cam gear driven by said motor and having cam elements to engage said cam receiving means for predetermined rotative relation of said wheel and said cam gear, and a timer lever urging said cam gear toward said timer setting wheel and movable upon engagement of said cam elements with said cam receiving means, said mechanism located between said other side wall and said sub-plate, cam members secured to the opposite ends of a shaft for supporting said digit shift means, a buzzer operating member operated by the leakage flux of said driving motor, one of said cam members engaging said timer lever, and the other said cam member engaging said buzzer operating member for transmitting the motion of said timer lever to said buzzer operating member through said shaft for supporting said digit shift means to actuate said buzzer when said cam elements and said cam receiving means are engaged.

2. The digital clock according to claim 1 wherein one pole piece of said driving motor extends outwardly through a casing thereof to operate said buzzer operating member.

3. The digit clock according to claim 1 wherein said time switch mechanism comprises a frame including a pair of spaced apart supporting members secured to one side thereof, and first spring anchor located between said supporting members, said timer setting wheel supported by said frame, said cam gear opposing said timer setting wheel, said timer lever including a base substantially parallel with said frame, a pair of legs extending from the opposite ends of said base toward said frame, and an arm projecting toward said frame from substantially the central portion of said base, a cam extension on the opposite side of said arm for engaging said one cam member, pins secured to said legs adapted to engage said frame for pivotally supporting said base, a second spring anchor secured to said base, and a spring connected between said first and second spring anchors for urging said arms against the side surface of said cam wheel so as to urge the same toward said timer setting wheel.

4. The digital clock according to claim 3 wherein each of said first and second spring anchors comprises an annular ring and a guide member at the center of said annular ring.

5. The digital clock according to claim 3 wherein said timer setting wheel takes the form of a bottomed cylinder with a set index provided around the periphery thereof, a boss connected to the bottom of said timer setting wheel for rotating the same, said bottom being provided with a plurality of arcuate grooves to form said cam receiving means, a one-way ratchet gear corresponding to said index, and a pawl for driving said ratchet gear.

6. The digital clock according to claim 5 which further comprises said cam gear in the form of a bottom cylinder having a dimension to be nested in said timer setting wheel and operated by said timer lever, said cam gear being provided with an internal gear and a gear meshing said internal gear for intermittently rotating the same when driven by said motor, and a plurality of arcuate projections on the bottom of said cam gear forming said cam elements and adapted to be received in the arcuate grooves of said timer setting wheel.

7. The digital clock according to claim 3 which further comprises said first cam member secured to a shaft extending between opposing side walls and provided with a pin which engages said cam extension of said timer lever, said second cam member also secured to said shaft and including a pin extending beneath said buzzer operating member, and a spring for biasing said pin of said second cam member to engage said buzzer operating member.

8. In a time switch device for use in a clock of the type comprising a cam gear slidably mounted on a shaft and driven by a clock mechanism, a timer setting wheel mounted on said shaft coaxially with said cam gear, manually operated means for rotating said timer setting wheel to a desired set position, a tiltably mounted timer lever for urging said cam gear toward said timer setting wheel, said cam gear and said timer setting wheel being provided cooperating cam projections and cam grooves on their opposing surfaces, said cam projections engaging said cam grooves at a predetermined time so as to tilt said timer lever for operating a switch, a repeat mechanism comprising a cam member provided for said timer lever, a switching lever provided with a cam pin and a pair of slots near the opposite ends thereof, a pair of stationary pins respectively extending through said slots for supporting said switching lever to be movable in the longitudinal direction, one of said slots being shaped to permit said switching lever to swing downwardly about one of said pins, said cam pin engaging said cam member when said switching lever is moved to the rearward position thus locking said time lever for opening said time switch device, a repeat lever pivotally supported at about the center, one end of said repeat lever abutting the lower edge of said switching lever while the other end of said repeat lever extending to the proximity of the cam member of said timer lever, a sector gear pivotally mounted on said other end of said repeat lever, said sector gear being adapted to mesh a timer drive gear which drives said cam gear when said repeat lever is rotated by said switching lever when the same is moved to the forward position and depressed, the rear end of said repeat lever engaging said cam member when said sector gear meshes said timer drive gear thereby locking said timer lever.

9. The repeat mechanism according to claim 8 wherein one of said slots near one end of said switching lever is horizontal, the width of the opposite ends of said one slot is substantially equal to the diameter of one pin received therein but the width of the intermediate portion of said one slot is slightly narrower than the diameter of said one pin, said one pin having a horizontal slit, so that the diameter of said one pin reduces slightly when the pin passes through said intermediate portion, the other of said slot has vertical and horizontal legs, a portion of said vertical leg has a width smaller than the diameter of the other pin received in said other slot, said other pin has a vertical slit so that the diameter of said other pin reduces slightly when said other pin passes through said portion of the vertical leg.

* * * * *

UNITED STATES PATENT AND TRADEMARK OFFICE

CERTIFICATE OF CORRECTION

PATENT NO. : 4,193,256

DATED : March 18, 1980

INVENTOR(S) : Kanji Tobeta et al.

It is certified that error appears in the above—identified patent and that said Letters Patent is hereby corrected as shown below:

Column 1, line 57, "layer" should read -- lever --.
Column 4, line 67, "the" (first occurrence) should read -- one --.
Column 7, line 37, "39A" should read -- 93A --.
Column 7, line 49, after "words" should read -- when --.
Column 11, line 32, "at" should read -- a --.
Column 5, line 63, "67b" should read -- 67B --.

Signed and Sealed this

*Seventh* Day of *October 1980*

[SEAL]

*Attest:*

SIDNEY A. DIAMOND

*Attesting Officer*

*Commissioner of Patents and Trademarks*